US009276361B2

(12) United States Patent
Peng

(10) Patent No.: US 9,276,361 B2
(45) Date of Patent: Mar. 1, 2016

(54) LAMP HOLDER

(71) Applicant: Rich Brand Industries Limited, Talang Town, Dongguan (CN)

(72) Inventor: Te-Shui Peng, Taoyuan County (TW)

(73) Assignee: RICH BRAND INDUSTRIES LIMITED, Dongguan, Guangdong Province (CN)

( * ) Notice: Subject to any disclaimer, the term of this patent is extended or adjusted under 35 U.S.C. 154(b) by 39 days.

(21) Appl. No.: 14/444,580

(22) Filed: Jul. 28, 2014

(65) Prior Publication Data

US 2016/0028196 A1 Jan. 28, 2016

(51) Int. Cl.

| | |
|---|---|
| ***H01R 13/70*** | (2006.01) |
| ***H01R 33/22*** | (2006.01) |
| ***H01H 3/08*** | (2006.01) |
| ***H01H 3/34*** | (2006.01) |

(52) U.S. Cl.

CPC ..... *H01R 13/70* (2013.01); *H01H 3/08* (2013.01); *H01H 3/34* (2013.01); *H01R 33/22* (2013.01)

(58) Field of Classification Search

CPC .. H01R 33/22; H01R 33/955; H01R 33/9555; H01R 33/945; H01R 33/96; H01R 33/962; H01R 13/66; H01R 13/70; H01R 13/71; H01R 33/46; H01H 3/08; H01H 3/10; H01H 3/38; H01H 3/42; H01H 3/34

See application file for complete search history.

(56) References Cited

U.S. PATENT DOCUMENTS

| | | | | | |
|---|---|---|---|---|---|
| 2,101,680 | A * | 12/1937 | Johnson | F21S 8/033 | 200/51.01 |
| 2,483,120 | A * | 9/1949 | Benander | H01R 33/9555 | 200/51.12 |
| 4,214,135 | A * | 7/1980 | Munroe | H01R 33/9555 | 200/51.14 |
| 4,432,593 | A * | 2/1984 | Waluk | H01R 13/42 | 439/456 |
| 4,660,906 | A * | 4/1987 | Haraden | H01R 33/22 | 439/11 |
| 4,685,759 | A * | 8/1987 | Kurtz | H01R 33/9555 | 200/336 |
| 6,171,135 | B1 * | 1/2001 | Yang | H01R 13/5825 | 439/456 |
| 2008/0259592 | A1 * | 10/2008 | Huang | F21V 23/0442 | 362/95 |

* cited by examiner

*Primary Examiner* — Hargobind S Sawhney
(74) *Attorney, Agent, or Firm* — Bacon & Thomas, PLLC

(57) ABSTRACT

A lamp holder includes a main body, a switch device and a mounting bracket. The main body has an axial end for connecting a light emitting element and another axial end having an electrically conductive module, and the switch device is installed in the main body, and the switch device and the electrically conductive module jointly control the light emitting element to be turned on or off. The rotary handle of the switch device is installed at an axial end of the main body and protruded out from the main body, and the mounting bracket encloses the rotary handle and locks with the main body. Therefore, the lamp holder can be installed onto a decorative shelter conveniently, and the rotary handle can be turned without limitation, and the lamp holder has a good appearance.

5 Claims, 10 Drawing Sheets

LAMP HOLDER

BACKGROUND OF THE INVENTION

1. Field of the Invention

The present invention relates to a lamp holder, and more particularly to the lamp holder having a conveniently installed decorative shelter, and a rotary handle rotatable without limitation and providing a better aesthetic look.

2. Description of the Related Art

With reference to FIG. 1 for a conventional lamp holder 1, the lamp holder comprises a cylindrical casing 11, an insulated casing 12, an insulated holder body 13 and a switch device 14. The cylindrical casing 11 is electrically conductive and provided for screwing and connecting a light emitting element (such as a light bulb, not shown in the figure), and a first electrode of the light emitting element is coupled to a positive electrode of a power supply (such as utility power) installed in the insulated holder body 13 to achieve an electric connection for a close or open circuit, and a second electrode of the light emitting element is in contact with the cylindrical casing 11 to achieve an electric connection of a negative electrode of the power supply. The insulated holder body 13 is installed at the top of the cylindrical casing 11, and the insulated casing 12 is covered onto the cylindrical casing 11 and the exterior of the insulated holder body 13. The switch device 14 is installed in the insulated holder body 13, and a rotatable knob 142 is installed transversally from a rotary shaft 141. During installation, two bare ends of a power cable 15 are plugged into the top of the insulated holder body 13 for connecting a positive electrode of a power supply (such as utility power) to the switch device 14, and connecting a negative electrode of the power supply to the cylindrical casing 11, so that a user may turn the knob 142 to operate the connection with the positive electrode of the switch device 14 for switching between CLOSE and OPEN statuses, so as to control the light emitting element to be turned on and off respectively.

The use of the conventional lamp holder 1 is very convenient, but the knob 142 is protruded transversally from the lateral side of the insulated holder body 13 and its existence occupies some of the operating space, so that if it is necessary to cover the lamp holder for a better decorative effect, the existence of the knob 142 definitely affects the smooth operation and requires further spatial design. If the knob 142 is installed at the rear of the shelter (such as a decorative plate), the knob 142 will be attached closely to the shelter, and the operation of turning the knob 142 becomes very inconvenient. If the knob 142 is installed at the front of the shelter (such as a decorative plate), the aesthetic look of the lamp holder is affected adversely in addition to the inconvenient operation of the knob 142.

To overcome the aforementioned problems of the knob 142 of the lamp holder 1 being installed transversally on the lateral side of the lamp holder 1 and the decorative shelter affecting the smooth operation, the present invention provides a feasible design of a innovative lamp holder, so that manufacturers can install the lamp holder at any decorative shelter position, and provide diversified applications of the lamp holder.

SUMMARY OF THE INVENTION

In view of the foregoing drawbacks of the prior art, the inventor or the present invention designed and developed a lamp holder in accordance with the present invention to overcome the drawbacks of the prior art.

Therefore, it is a primary objective of the present invention to provide a lamp holder that can be installed on a decorative shelter conveniently.

Another objective of the present invention is to provide a lamp holder whose rotary handle can be turned without any limitation after the rotary handle is installed on a decorative shelter.

A further objective of the present invention is to provide a lamp holder with a better aesthetic look after the lamp holder is installed on a decorative shelter.

To achieve the aforementioned objective, the present invention provides a lamp holder comprising a main body, a switch device and a mounting bracket, and the main body having an axial end for screwing and coupling a light emitting element, and the other axial end with an electrically conductive module installed therein, and the switch device being installed in the main body and operated with the electrically conductive module to jointly control the ON and OFF operation of the light emitting element sequentially, characterized in that the switch device comprises a rotary handle installed at an axial end of the main body and protruded out of the main body, and the mounting bracket being sheathed on the rotary handle and locked with the main body.

In the aforementioned lamp holder, the switch device is comprised of a rotary handle and an elastic element, and the rotary handle has a transverse groove formed at the bottom of the rotary handle and a slot penetrating longitudinally therein for receiving the elastic element.

In the aforementioned lamp holder, the rotary handle has an anti-slip surface formed at the top end of the rotary handle to facilitate users to grip and rotate the rotary handle.

In the aforementioned lamp holder, the switch device is comprised of an active rotary handle, a passive rotary handle and an elastic element, and the active rotary handle has a slot formed and penetrating deeply into the bottom of the active rotary handle, and an active ratchet disc formed at an end surface of the active rotary handle; the passive rotary handle is contained in a slot of the active rotary handle, and includes a transverse groove formed at an end of the passive rotary handle and a slot penetrated longitudinally and deeply for receiving the elastic element, and the other end surface has a passive ratchet disc corresponding to the active ratchet disc of the active rotary handle.

In the aforementioned lamp holder, the active rotary handle has an anti-slip surface formed at the top end of the active rotary handle to facilitate users to grip and rotate the active rotary handle.

In the aforementioned lamp holder, the mounting bracket is substantially n-shaped, and has a via hole vertically penetrating through the middle of the top of the mounting bracket, and the external periphery of the via hole has an external thread, a pressing plate extended downwardly and outwardly from both sides of the via hole, a locking hole formed on each of the pressing plates, and provided for passing a fastener to secure the main body.

DETAILED DESCRIPTION OF THE PREFERRED EMBODIMENTS

The technical characteristics, contents, advantages and effects of the present invention will be apparent with the detailed description of a preferred embodiment accompanied with related drawings as follows.

Figure 1:
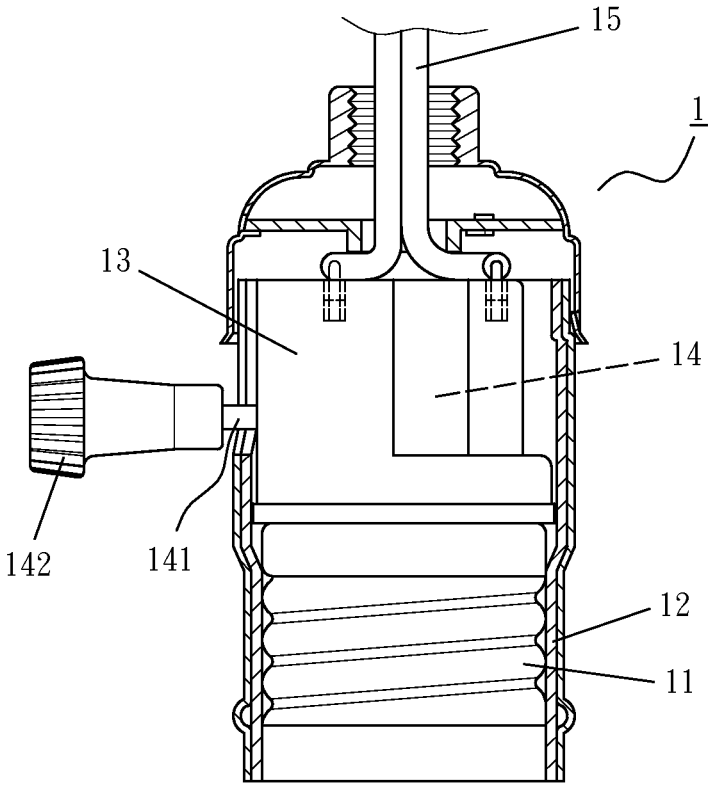
FIG. 1 (PRIOR ART)
FIG. 1 is a sectional view of a conventional lamp holder.
Figure 2:
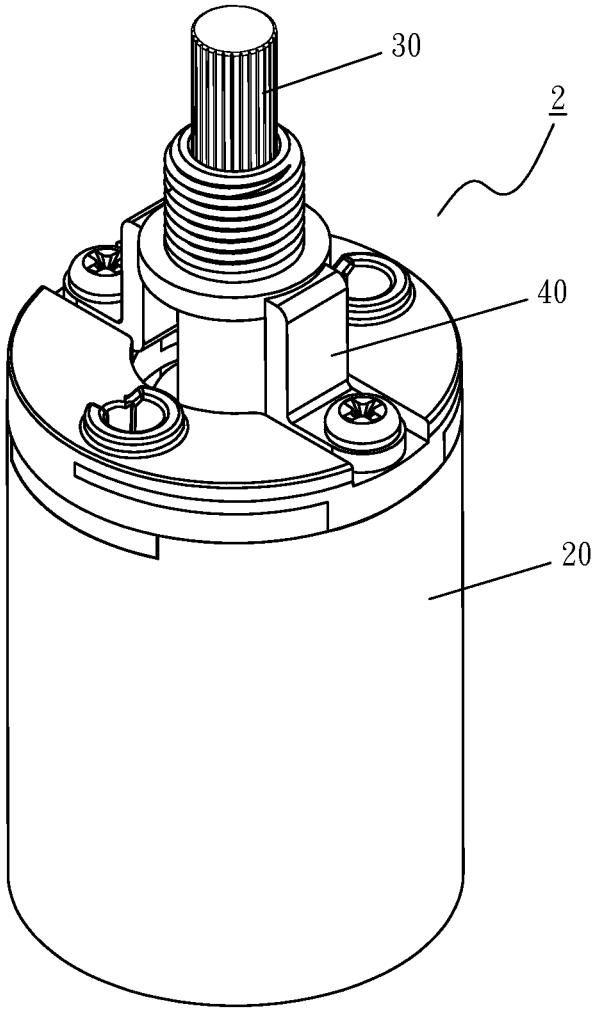
FIG. 2 is a perspective view of a lamp holder in accordance with a first preferred embodiment of the present invention.

With reference to FIG. 2 for a lamp holder 2 of the first preferred embodiment of the present invention, the lamp holder 2 comprises a main body 20, a switch device 30 and a mounting bracket 40, wherein the main body 20 is a cylindrical body, and the switch device 30 is installed at an end of the main body 20, and the mounting bracket 40 encloses the switch device 30 and connects the main body 20.

With reference to FIGS. 3 to 8, the main body 20 is comprised of a cylindrical casing 21, an insulated casing 22, an electrically conductive module 23 and an insulated top cover 24, wherein the cylindrical casing 21 is made of a conducting plate and manufactured into the shape of an open barrel, and a screw thread is formed on an inner wall of the cylindrical casing 21 and provided for screwing and connecting a head of a light emitting element (such as a light bulb, not shown in the figure), and a vast majority of the top of the cylindrical casing 21 is an opening 211 and just has a connecting hole 212 formed separately on two side plates of the cylindrical casing 21.

The insulated casing 22 is made of an insulating material and manufactured into the shape of a barrel, and the insulated casing 22 has a plurality of recessions formed at an end (or the top) of the insulated casing 22 for receiving and connecting other components and divided into a jitter-slope module 221 disposed at the center of the recession and arranged in a circumferential shape, a set of corresponding connecting slots 222, a set of corresponding locking holes 223, a set of corresponding screw holes 224, a positive electrode clamping plate slot 225 and a negative electrode clamping plate slot 226, and two sets of ratcheted slopes are arranged on a surface of the jitter-slope module 221, so that a vertical wall is formed between two adjacent slopes, and a containing space 227 is formed at the other end (or the bottom) of the insulated casing 22 for receiving the cylindrical casing 21.

The electrically conductive module 23 is installed at a corresponding receiving or connecting position at the top of the insulated casing 22, and the electrically conductive module 23 comprises a rotating guide 231, a set of connecting elements 232 (such as rivets) and a set of locking elements 233 (such as rivets), a set of connecting plates 234, a positive electrode clamping plate 235, a negative electrode clamping plate 236 and a positive electrode conducting plate 237, wherein the connecting plate 234, the positive electrode clamping plate 235, the negative electrode clamping plate 236 and the positive electrode conducting plate 237 have a penetrating hole portion and a plate portion. In the assembling process, the plate portion of the negative electrode clamping plate 236 is contained in the negative electrode clamping plate slot 226, so that the penetrating hole portion of the negative electrode clamping plate 236 is attached onto one of the corresponding connecting slots 222, and one of the connecting elements 232 is passed into the penetrating hole portion of the negative electrode clamping plate 236 and the corresponding connecting slot 222 and coupled a connecting hole 212 of the cylindrical casing 21, and the other connecting element 232 is passed into the other connecting slot 222 and coupled to the other connecting hole 212, so that the cylindrical casing 21 is fixed into the containing space 227 of the insulated casing 22, and an electric conduction between the negative electrode clamping plate 236 and the cylindrical casing 21 is achieved.

The penetrating hole portion of the set of connecting plates 234 are attached and covered onto the locking holes 223 of the insulated casing 22 respectively, and the plate portions of the set of connecting plates 234 are attached and covered onto one of the sets of symmetric slopes of the jitter-slope module 221, and then the plate portions of the positive electrode clamping plate 235 are contained into the positive electrode clamping plate slots 225 respectively, so that the penetrating hole portions of the positive electrode clamping plate 235 are attached and covered onto the penetrating hole portions of one of the connecting plates 234. Further, one of the locking elements 233 is passed into the penetrating hole portion of the positive electrode clamping plate 235 and the penetrating hole portion of the connecting plate 234 is coupled to the locking hole 223 of the insulated casing 22. In the meantime, the positive electrode conducting plate 237 is placed at the opening 211 of the cylindrical casing 21, and the penetrating hole portion of the positive electrode conducting plate 237 is attached and covered onto the bottom of the other locking hole 223, and the other locking element 233 is passed into the penetrating hole portion of the corresponding connecting plate 234 and the locking hole 223 of the insulated casing 22 is coupled to the penetrating hole portion of the positive electrode conducting plate 237, so that an electric conduction between the positive electrode clamping plate 235 and one of the connecting plates 234 is achieved. In the meantime, an electric conduction between the positive electrode conducting plate 237 and the other connecting plate 234 is achieved. And then, the rotating guide 231 is put onto the jitter-slope module 221, so as to complete assembling the cylindrical casing 21, the insulated casing 22 and the electrically conductive module 23 (as shown in FIG. 4).

The insulated top cover 24 is made of an insulating material and manufactured in the shape of a circular disc, and the insulated top cover 24 is covered onto the top of the insulated casing 22, and a long concave positioning notch 241 is formed on the top of the insulated top cover 24, and a circular through hole 242 is formed at the center of the insulated top cover 24, and a locking penetrating hole 243 is formed separately on two sides of the positioning notch 241, and two plug holes 244 are formed at the top of the insulated top cover 24 for plugging a power cable.

Figure 3:
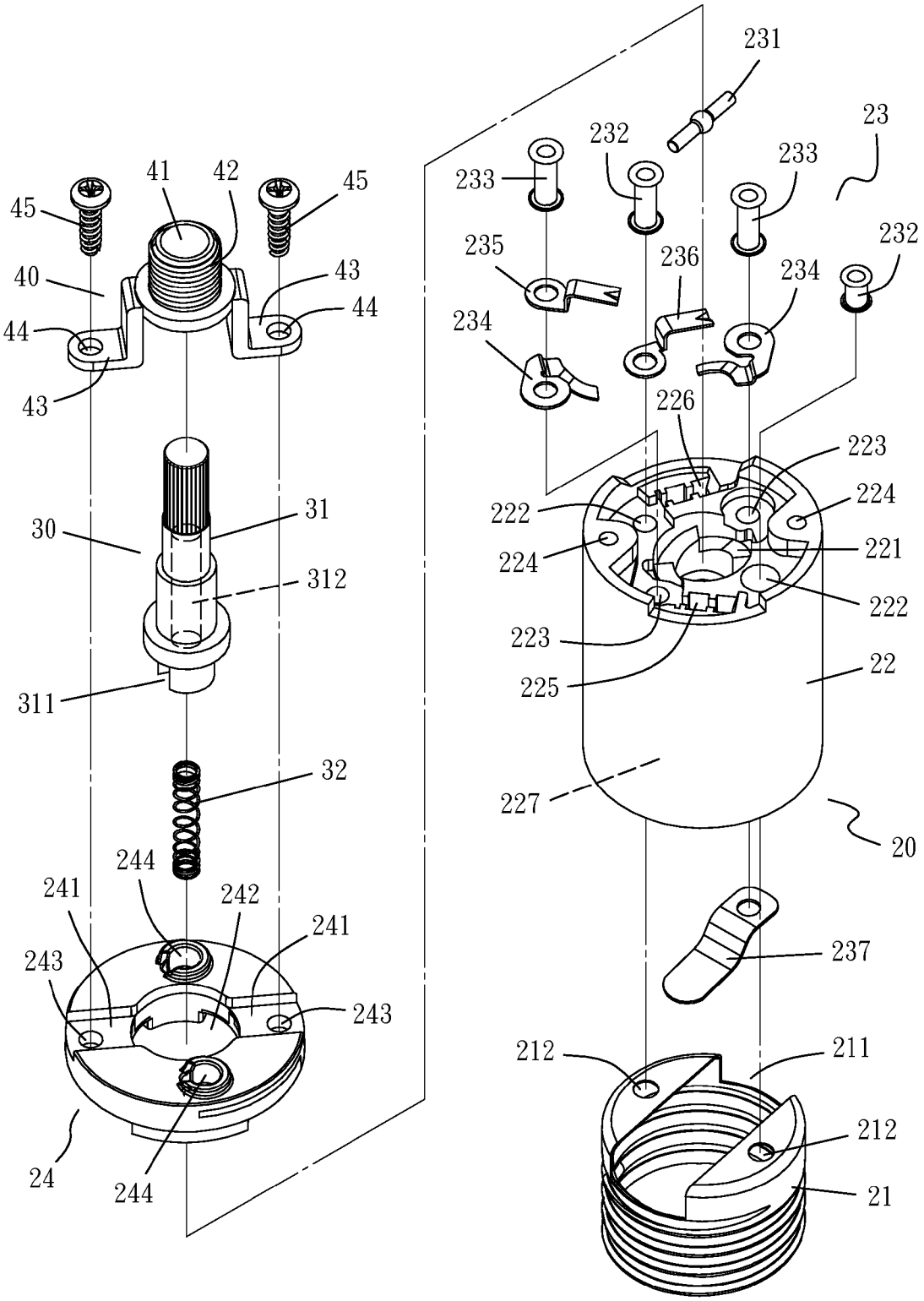
FIG. 3 is an exploded view of a lamp holder in accordance with the first preferred embodiment of the present invention.
Figure 5:
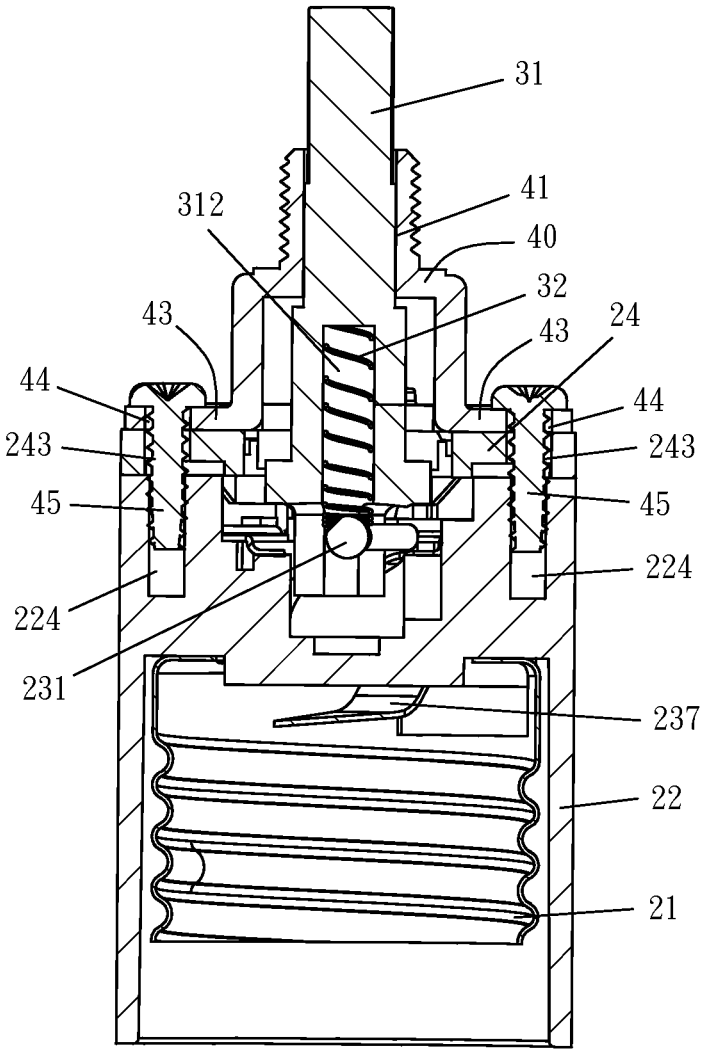
FIG. 5 is a sectional view of the lamp holder in accordance with the first preferred embodiment of the present invention.

The switch device 30 is comprised of a rotary handle 31 and an elastic element 32, and an end (or the top end) of the rotary handle 31 has an anti-slip surface to facilitate a user to grip the rotary handle 31 by fingers, and the other end (or the bottom end) has a transverse groove 311, and a slot 312 penetrated longitudinally and deeply into the rotary handle 31 for receiving the elastic element 32 (as shown in FIGS. 3 and 5). The mounting bracket 40 is substantially n-shaped and has a via hole 41 penetrating from the top to the bottom, and the via hole 41 has an external thread 42 formed on an outer side of the via hole 41, a pressing plate 43 extended downwardly and outwardly from the via hole 41, and each pressing plate 43 has a locking penetrating hole 44 for passing a fastener 45 (such as a screw).

Figure 4:
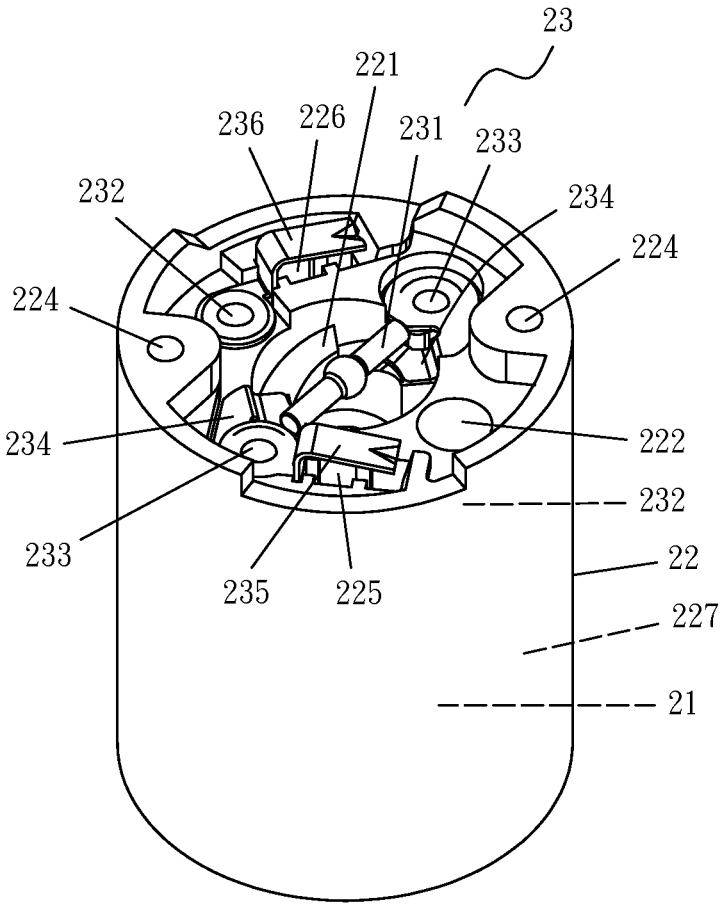
FIG. 4 is a perspective view showing some parts of the lamp holder in accordance with the first preferred embodiment of the present invention.

After the cylindrical casing 21, the insulated casing 22 and the electrically conductive module 23 are assembled as shown in FIG. 4, the insulated top cover 24 is covered onto the top of the insulated casing 22, so that the locking penetrating hole 243 of the insulated top cover 24 is aligned precisely with the screw hole 224 of the insulated casing 22, and the plug hole 244 of the insulated top cover 24 is aligned precisely with the positive and negative electrode clamping plates 235, 236, and the circular through hole 242 covers the range of the jitter-slope module 221. The elastic element 32 is contained in the slot 312 of the rotary handle 31, and then the bottom of the rotary handle 31 is plugged in a direction towards the circular through hole 242, so that the center of the jitter-slope module 221 drives the groove 311 at the bottom of the rotary handle 31 to be sheathed on the rotating guide 234 precisely. Now, the rotating guide 234 abuts and compresses the elastic element 32. Finally, the via hole 41 of the mounting bracket 40 is sheathed on the rotary handle 31. In other words, the rotary handle 31 is passed and installed into the via hole 41 of the mounting bracket 40, and the pressing plate 43 of the mounting bracket 40 abuts against the positioning notch 241 of the insulated casing 22 for the positioning purpose, and the two locking penetrating holes 44 are aligned with the locking penetrating holes 243 of the insulated top cover 24 precisely, and then two fasteners 45 are passed through the locking penetrating holes 44, 243 and secured with the screw holes 224 of the insulated casing 22 respectively, so as to complete assembling the whole lamp holder 2 as shown in FIG. 5.

Figure 6:
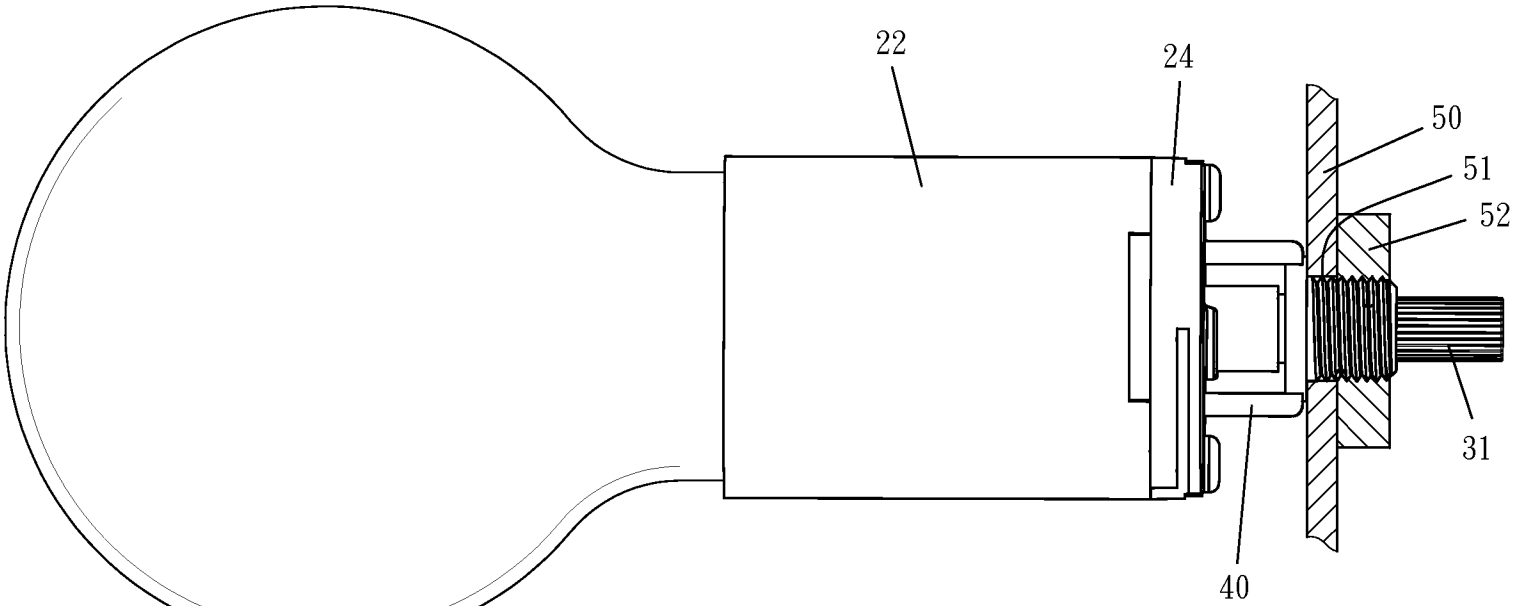
FIG. 6 is a schematic view of the lamp holder combined with a shelter in accordance with the first preferred embodiment of the present invention.

In FIG. 6, when the lamp holder 2 is installed onto a decorative shelter 50 (such as a decorative plate) during an assembling process, a through opening 51 is formed on the shelter 50 for passing the portion of the external thread 42 of the lamp holder 2 from a side of the shelter 50, and then the other side of the shelter 50 is secured with the portion of the external thread 42 by a locking element 52 (such as a nut), so that the lamp holder 2 is securely mounted onto the shelter 50. Since the rotary handle 31 is installed at the position of an axial end of the lamp holder 2 (but not installed on a lateral side of the lamp holder 2), therefore the rotary handle 31 will not affect the smooth decoration job during the decorative sheltering process. In addition, the rotary handle 31 is installed at a position which is not adjacent to the shelter 50, so that the operation of turning the rotary handle 31 can be performed smoothly without being restricted by the shelter 50. Further, the rotary handle 31 cannot be seen from the front of the shelter 50, and thus the invention provides an aesthetic appearance of the lamp holder.

Figure 7:
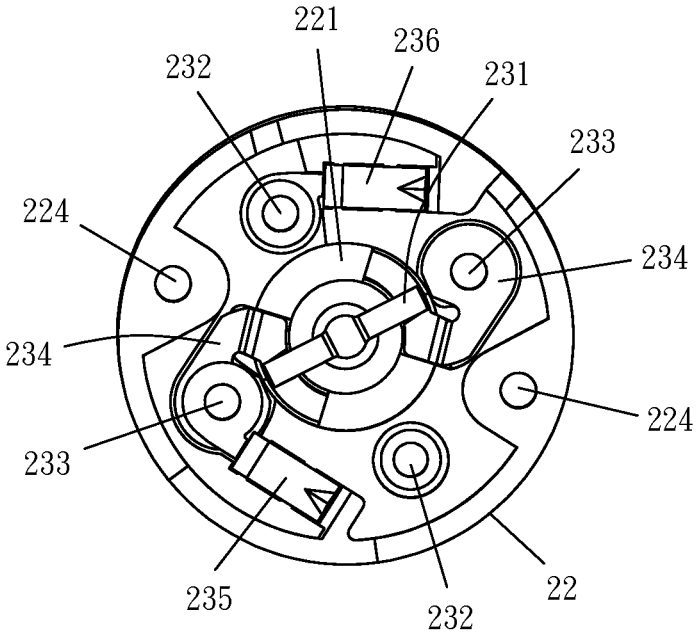
FIG. 7 is a schematic view of a power-on (close) status of the lamp holder in accordance with the first preferred embodiment of the present invention.
Figure 8:
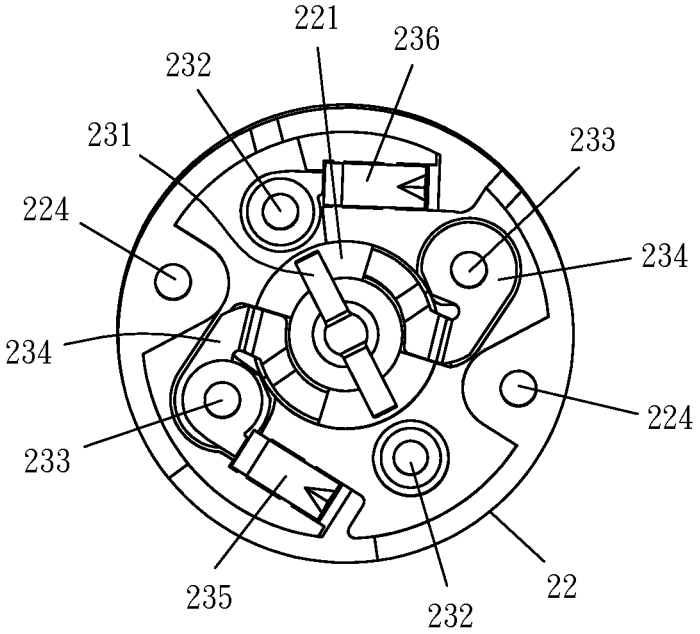
FIG. 8 is a schematic view of a power-off (open) status of the lamp holder in accordance with the first preferred embodiment of the present invention.

When use, the power cable is passed through the shelter 50 as needed, and then two bare ends of the power cable are plugged into two plug holes 244 of the insulated top cover 24 respectively, so that the two bare ends are securely and respectively connected to the positive and negative electrode clamping plates 235, 236, so as to connect the power supply to the positive and negative electrode clamping plates 235, 236, wherein the negative electrode of the power supply is electrically conducted with the cylindrical casing 21 through the negative electrode clamping plate 236 and the connecting element 232. The positive electrode of the power supply is electrically conducted with one of the connecting plates 234 through the positive electrode clamping plate 235, and then electrically conducted with the other connecting plate 234 through the rotating guide 231, and further electrically conducted with the positive electrode conducting plate 237. To electrically connect or disconnect the two connecting plates 234 (for a close circuit or an open circuit) the rotating guide 231 of the switch device 30 is operated to jitter on the symmetric slopes of the jitter-slope module 221 as shown in FIG. 7, such that when both ends of the rotating guide 231 abut the two connecting plates 234 respectively, the two connecting plates 234 are electrically connected to define a close circuit, so as to turn on a light emitting element (such as a light bulb) the screwed into the cylindrical casing 21. When the rotary handle 31 is turned to drive the rotating guide 231 to climb up the slope of the two connecting plates 234 (since the rotating guide 231 descending along the slope will be blocked by the vertical wall, therefore the rotating guide 231 can only climb up the slope). As long as the rotating guide 231 passes through the highest point, both ends of the rotating guide 231 will fall onto an insulated slope without having the connecting plate 234. In FIG. 8, the two connecting plates 234 are disconnected to define an open circuit, so that the light emitting element screwed and connected into the cylindrical casing 21 is turned off immediately. The compression force exerted by the elastic element 32 in the rotary handle 31 forces the rotating guide 231 to always abut against the jitter-slope module 221, so that when the rotary handle 31 drives the rotating guide 231 to rotate accordingly on the symmetric slope of the jitter-slope module 221, the light emitting element will be turned on and off accordingly.

Figure 9:
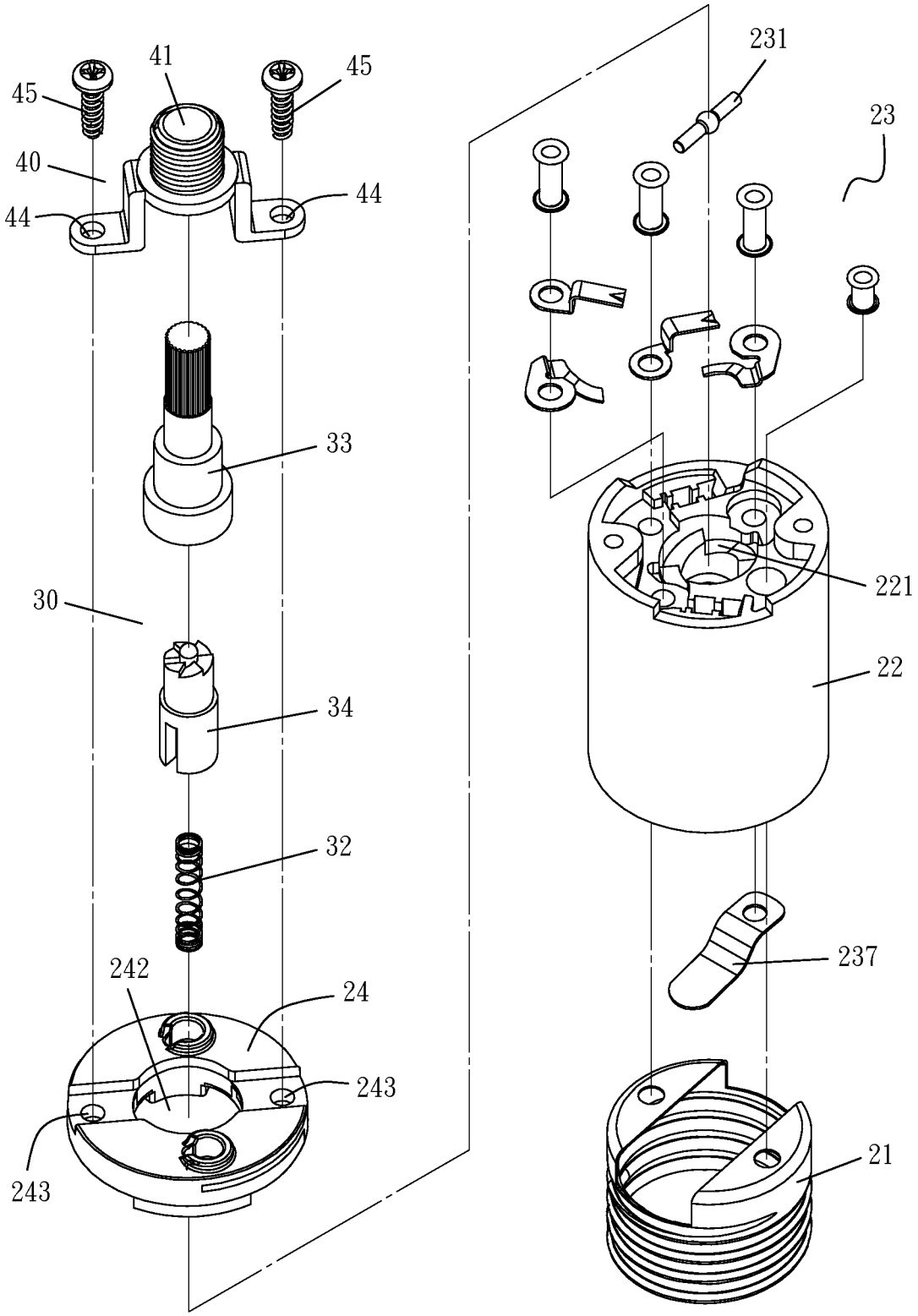
FIG. 9 is an exploded view of a lamp holder in accordance with a second preferred embodiment of the present invention.
Figure 10:
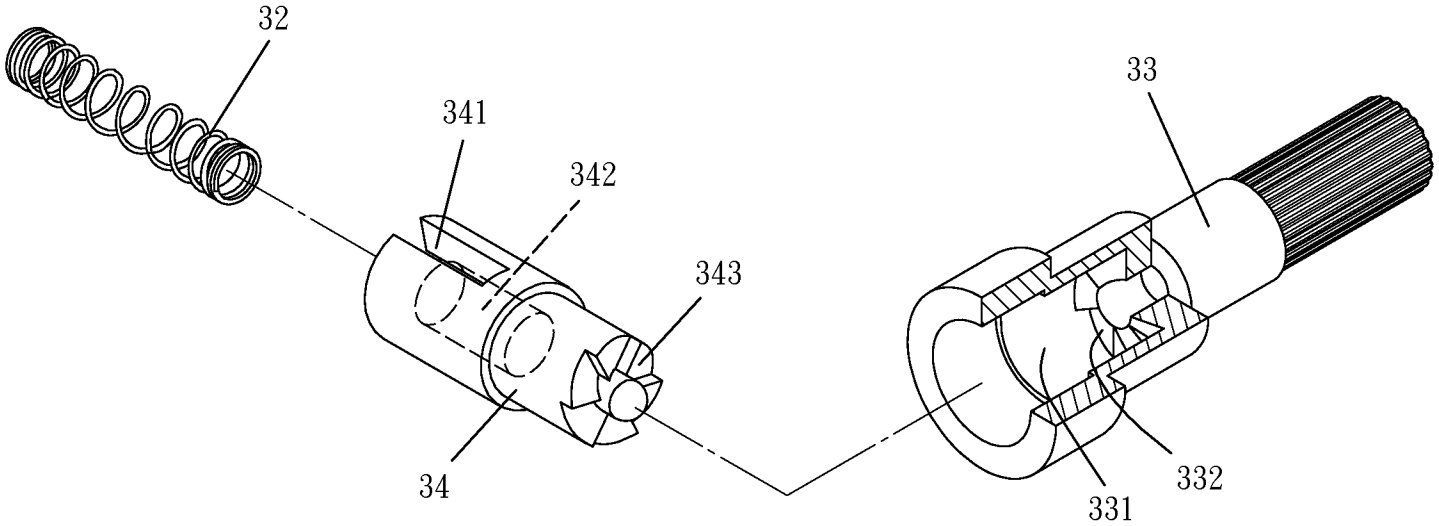
FIG. 10 is an exploded view of a switch device of the lamp holder in accordance with the second preferred embodiment of the present invention.

In the first preferred embodiment, the rotary handle 31 drives the rotating guide 231 to rotate in a single direction only. In other words, the rotary handle 31 can be rotated in one direction, but cannot be rotated in an opposite direction, and thus it is an assembly and an operating mode referred as "irreversible rotation". With reference to FIGS. 9 and 10 for a lamp holder 2 of the second preferred embodiment of the present invention, the structure of this preferred embodiment is substantially the same as that of the first preferred embodiment, and the same components and parts are represented by the same names and numerals to facilitate the illustration of the embodiments. The difference between the lamp holder 2 of the second preferred embodiment and the lamp holder 2 of the first preferred embodiment resides on that the switch device 30 is comprised of an active rotary handle 33, a passive rotary handle 34 and an elastic element 32. In FIG. 10, an end (or the top end) of the active rotary handle 33 has an anti-slip surface for facilitating a user to grip by fingers, and the other end (or the bottom end) of the active rotary handle 33 is penetrated deeply into a slot 331 and has an active ratchet disc 332 formed on an end surface of the active rotary handle 33. The passive rotary handle 34 has a transverse groove 341 formed at an end of the passive rotary handle 34, and a slot 342 concavely and longitudinally formed thereon for receiving the elastic element 32, and the other end surface has a passive ratchet disc 343 corresponsive to the active ratchet disc 332 of the active rotary handle 33.

Figure 11:
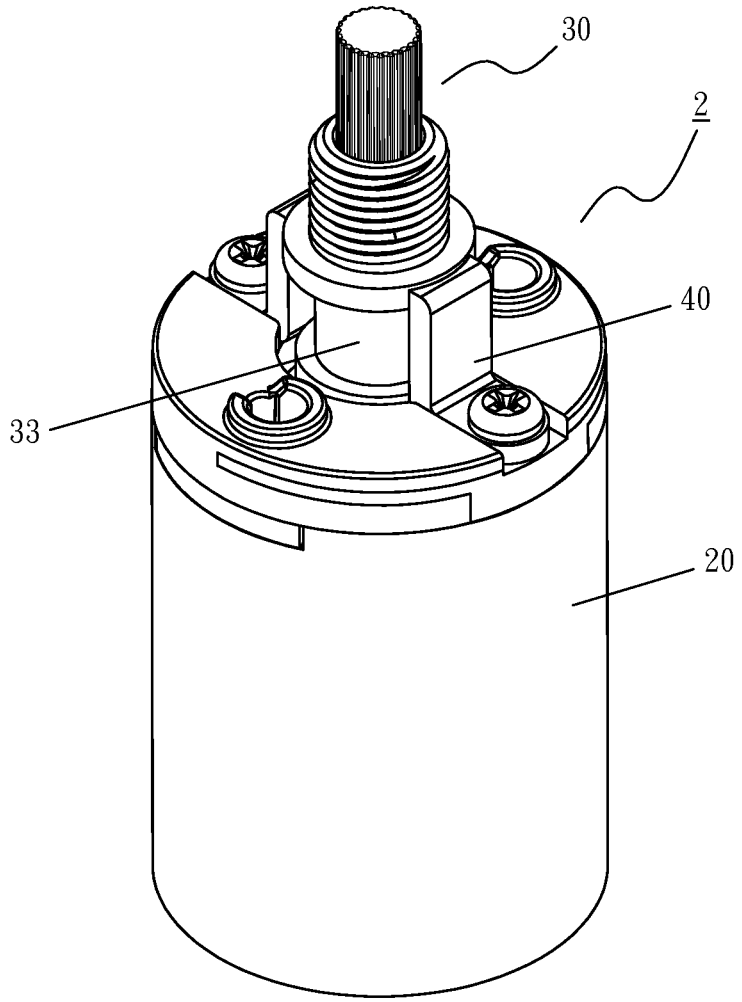
FIG. 11 is a perspective view of the lamp holder in accordance with the second preferred embodiment of the present invention.

In the assembling process, an end of the passive rotary handle 34 having the passive ratchet disc 343 is placed into the slot 331 of the active rotary handle 33, so that the passive ratchet disc 343 and the active ratchet disc 332 are attached tightly and completely, and then the bottom of the passive rotary handle 34 is plugged into the circular through hole 242 of the insulated top cover 24 to the center of the jitter-slope module 221, so that the groove 341 formed at the bottom of the passive rotary handle 34 is aligned with and sheathed on the rotating guide 234 precisely. Now, the rotating guide 234 presses the elastic element 32 to compress, and then the via hole 41 of the mounting bracket 40 is sheathed on the active rotary handle 33, and two fasteners 45 are passed through the locking penetrating holes 44 and 243 and the screw holes 224 of the insulated casing 22 respectively. Therefore, a lamp holder 2 of the second preferred embodiment as shown in FIG. 11 is assembled.

When use, the active rotary handle 33 is turned in a forward direction, and each vertical wall of the active ratchet disc 332 abuts each respective vertical wall of the passive ratchet disc 343, so that the passive rotary handle 34 is pushed and rotated to achieve the same effect of the first preferred embodiment to drive the rotating guide 231 to rotate on the symmetric slope of the jitter-slope module 221 sequentially, so that the light emitting element is turned on and off respectively. When the active rotary handle 33 is turned in a reverse direction, the rotating guide 231 driven by the groove 341 at the bottom of the passive rotary handle 34 is blocked by the vertical wall of the jitter-slope module 221 and cannot be rotated in the reverse direction accordingly, so that each slope on the active ratchet disc 332 of the active rotary handle 33 slides with respect to each slope of the passive ratchet disc 343 to force the elastic element 32 to compress. After the slope slide to the highest point, the slope falls onto an adjacent slope, and such operation drives the active rotary handle 33 to rotate in the reverse direction, and thus it is called an assembly and an operation mode of "reversible rotation".

From the description above, the lamp holder of the present invention comprises a main body, a switch device and a mounting bracket, and an axial end of the main body is provided for screwing and connecting a light emitting element, and the other axial end of the main body has an electrically conductive module installed therein, and the switch device is installed in the main body, and the switch device and the electrically conductive module jointly control the light emitting element to be turned on or off. The invention is characterized in that the rotary handle of the switch device is installed at an axial end of the main body and protruded out from the main body, and the mounting bracket encloses the rotary handle and locks with the main body. With such structure, the lamp holder can be installed on the decorative shelter conveniently, and the rotary handle can be turned without limitation, and the overall appearance of the lamp holder is enhanced.

In summation of the description above, the present invention complies with the patent application requirements, and thus is duly filed for patent application. While the invention has been described by means of specific embodiments, numerous modifications and variations could be made thereto by those skilled in the art without departing from the scope and spirit of the invention set forth in the claims.

What is claimed is:

1. A lamp holder, comprising a main body, a switch device and a mounting bracket, and the main body having an axial end for screwing and coupling a light emitting element, and the other axial end with an electrically conductive module installed therein, and the switch device being installed in the main body and operated with the electrically conductive module to jointly control the ON and OFF operation of the light emitting element sequentially, characterized in that the switch device comprises a rotary handle installed at an axial end of the main body and protruded out of the main body, an elastic element, the rotary handle having a transverse groove formed at the bottom thereof and a slot penetrating longitudinally therein for receiving the elastic element, and the mounting bracket being sheathed on the rotary handle and locked with the main body.

2. The lamp holder of claim 1, wherein the rotary handle has an anti-slip surface formed at the top end of the rotary handle to facilitate users to grip and rotate the rotary handle.

3. The lamp holder of claim 1, wherein the rotary handle is comprised of an active rotary handle and a passive rotary handle, and the active rotary handle has a slot formed and penetrating deeply into the bottom of the active rotary handle, and an active ratchet disc formed at an end surface of the active rotary handle; the passive rotary handle is contained in a slot of the active rotary handle, and includes a transverse groove formed at an end of the passive rotary handle and slot penetrated longitudinally and deeply for receiving the elastic element, and other end surface has a passive ratchet disc corresponding to the active ratchet disc of the active rotary handle.

4. The lamp holder of claim 3, wherein the active rotary handle has an anti-slip surface formed at the top end of the active rotary handle to facilitate users to grip and rotate the active rotary handle.

5. The lamp holder of claim 1, wherein the mounting bracket is substantially n-shaped, and has a via hole vertically penetrating through the middle of the top of the mounting bracket, and the external periphery of the via hole has an external thread, a pressing plate extended downwardly and outwardly from both sides of the via hole, a locking hole formed on each of the pressing plates, and provided for passing a fastener to secure the main body.

* * * * *